US010617969B2

(12) United States Patent
Landau

(10) Patent No.: US 10,617,969 B2
(45) Date of Patent: Apr. 14, 2020

(54) TOY BUILDING BLOCKS SET AND COOPERATING SCREWS

(71) Applicant: BJ Trading LLC, Jackson, NJ (US)

(72) Inventor: Boruch Landau, Lakewood, NJ (US)

(73) Assignee: BJ Trading LLC, Jackson, NJ (US)

( * ) Notice: Subject to any disclaimer, the term of this patent is extended or adjusted under 35 U.S.C. 154(b) by 0 days.

(21) Appl. No.: 16/045,318

(22) Filed: Jul. 25, 2018

(65) Prior Publication Data

US 2019/0030451 A1 Jan. 31, 2019

Related U.S. Application Data

(60) Provisional application No. 62/536,742, filed on Jul. 25, 2017.

(51) Int. Cl.

| | |
|---|---|
| ***A63H 33/06*** | (2006.01) |
| ***A63H 33/04*** | (2006.01) |
| ***A63H 33/10*** | (2006.01) |

(52) U.S. Cl.

CPC ..... *A63H 33/107* (2013.01)

(58) Field of Classification Search

CPC .... A63H 33/107; A63H 33/086; A63H 33/04; A63H 33/102; A63H 33/106; A63H 33/062; A63H 33/10; A63H 33/08; A63H 33/103; A63H 33/14

USPC ..... 446/75, 85, 91, 92, 98, 100, 116–128

See application file for complete search history.

(56) References Cited

U.S. PATENT DOCUMENTS

| | | | | | |
|---|---|---|---|---|---|
| 3,689,075 | A * | 9/1972 | Adelsohn | A63F 9/12 | 273/157 R |
| 5,152,530 | A * | 10/1992 | Dodek, II | A63F 9/12 | 273/156 |
| 5,306,198 | A * | 4/1994 | Forman | A63F 9/0098 | 446/116 |
| 9,689,160 | B2 * | 6/2017 | Lanese | E04B 2/06 | |
| 2003/0148700 | A1 * | 8/2003 | Arlinsky | A63H 33/04 | 446/91 |
| 2006/0194505 | A1 * | 8/2006 | Rolf | A63H 33/086 | 446/118 |
| 2008/0139077 | A1 * | 6/2008 | Patton | A63H 33/046 | 446/92 |
| 2008/0160875 | A1 * | 7/2008 | Leicht | A63F 9/12 | 446/124 |

* cited by examiner

*Primary Examiner* — Nini F Legesse
(74) *Attorney, Agent, or Firm* — Amster, Rothstein & Ebenstein LLP

(57) ABSTRACT

A building block set having a series of blocks and screws for connecting blocks. The blocks are provided with screw holes to receive screws. The screws insert into a block and extend into a neighboring block. Some of the screws are provided with screw heads having threaded channels that are configured to receive terminal ends of other screws.

4 Claims, 7 Drawing Sheets

TOY BUILDING BLOCKS SET AND COOPERATING SCREWS

RELATED APPLICATIONS

This application claims the benefit of U.S. Prov. Appl. 62/536,742 filed Jul. 25, 2017, the contents of which are incorporated by reference herein.

FIELD OF THE INVENTION

The invention relates to the field of toys, more specifically to a building block set that is adapted for connection by way of screws.

BACKGROUND OF THE INVENTION

Blocks and construction toys are commonly used as child play and educational devices across the globe. There is a need in the art for a building construction set that provides a user with expanded possibilities and building variations.

SUMMARY OF THE INVENTION

Embodiments of the invention set forth herein relate to a set of toy building blocks that are pre-drilled with a plurality of holes that are adapted to receive cooperating screws. In embodiments of the invention, screw heads are provided with threaded channels that are sized and shaped to receive cooperating screws. Screws of the invention are sized to have a length that is greater than the thickness of blocks they are suited to connect. In some embodiments of the invention, screws are sized to extend past a block a sufficient distance to insert into a channel in a cooperating screw head.

DETAILED DESCRIPTION OF THE INVENTION

Embodiments of the present invention will now be described with reference to the above-identified figures. However, the drawings and the description herein of the invention are not intended to limit the scope of the invention. It will be understood that various modifications of the present description of the invention are possible without departing from the spirit of the invention. Also, features or steps described herein may be omitted, additional steps or features may be included, and/or features or steps described herein may be combined in a manner different from the specific combinations recited herein without departing from the spirit of the invention, all as understood by those of skill in the art.

Figure 1A:
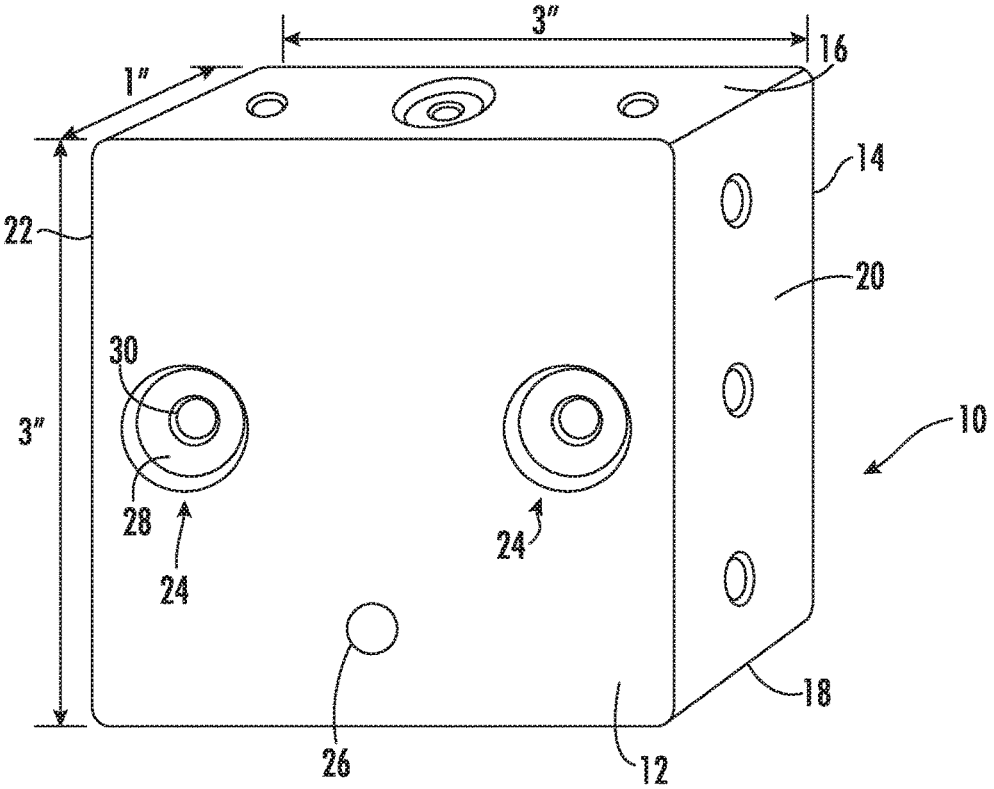
FIG. 1A is a front perspective view of a substantially cube-shaped block according to an exemplary embodiment of the invention.

FIG. 1A shows a front view of an exemplary building block according to an embodiment of the invention. As shown, block 10 is substantially cube-shaped having a front wall 12, a rear wall 14, a top wall 16 and a bottom wall 18, a right side wall 20 and a left side wall 22.

Blocks of the invention are provided with a series of screw holes that are adapted to receive respective screws. In embodiments of the invention, each block is provided with a plurality of such screw holes. Each screw hole opens on one wall of a block and traverses the thickness of the block to open on an opposite wall.

It will be understood that respective screw holes of the invention are provided with a first end having a recessed area and a second end that terminates open directly on the block wall without any recessed area. Still in other embodiment, screw holes may extend through a block to an opposite wall without any recessed segments.

For example, front wall 12 of block 10 is shown having at least two screw holes 24 that are adapted to receive a screw head. As shown, the first end of each of holes 24 are counterbored so as to form a recessed area 28. As shown, a channel 30 extending from the center of recessed area 28 and extends through the thickness of block 10 to open on rear wall 14. Recessed area 28 is sized and shaped to receive a screw head of a cooperating screw according to an embodiment of the invention. Holes 32, that open on rear wall 14 of block 10, on the other hand, are non-recessed holes that open directly into back rear wall 14.

Also shown in FIG. 1A, a non-recessed screw hole 26 also is provided on front wall 12 of block 10. Screw holes opens on front wall 12, and extends through block 10 to opening 34 on rear wall 14, forming a uniform channel through the block from the front wall 12 to the rear wall 14.

In embodiments of the invention, the inner channel areas proximate to holes 26, 32, and 34 are threaded. In this manner, holes such as 32 serve as an egress point for screws inserted through holes 24 on the front wall 12 of block 10, and they may also serve as an ingress point to receive threaded screws that emanate from neighboring blocks. In this manner, blocks of the invention are configured to, both, receive terminal end of a screw emanating from a neighboring block and allow for the insertion of a screw that extends through a thickness of the block and which terminates in a neighboring block.

Figure 1B:
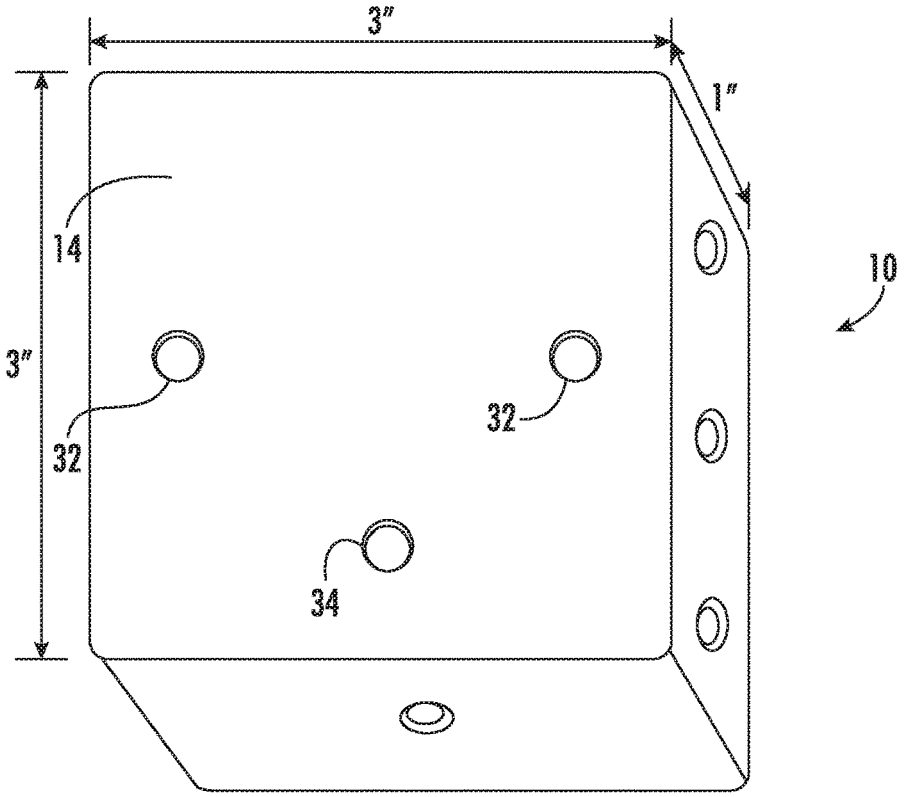
FIG. 1B is a rear perspective view of the block of FIG. 1A according to an exemplary embodiment of the invention.

Thus, in an exemplary assembly of two neighboring blocks of the type shown in FIG. 1, a screw having a length that is greater than the thickness of block 10 is inserted into hole 24 on the front wall 12 of block 10. The screw passes through the entire thickness of the block 10 and a segment of its terminal end exits out of hole 32 on the rear wall 14. The terminal segment that extends from hole 32 is inserted into any of the non-recessed holes in a neighboring block (e.g. holes 32, 34 on rear wall 14 or hole 26 on front wall 12). Alternatively, a screw extending from block 10 inserts into the upper channel of a screw previously inserted in a neighboring block.

In embodiments of the invention one or more holes may be provided from the front wall 12 to the rear wall 14, from the right wall 20 to the left wall 22 and from the top wall 16 to the bottom wall 18. Blocks may be of any various sizes and shapes and cooperating screws are provided to optionally traverse blocks' height, width, and depth and extend a sufficient distance to insert into a neighboring block. For example, in the case of a rectangular block, a screw that traverses the width of a block will be longer than a screw that traverses the height thereof.

In embodiments of the invention, recessed-holes provided on a first wall of a block terminate in non-recessed holes on the opposite wall of the back. In addition, in embodiment of the invention, respective holes on front and back surfaces of blocks are configured in an inverse pattern so as to allow optimal fastening options.

Figure 2A:
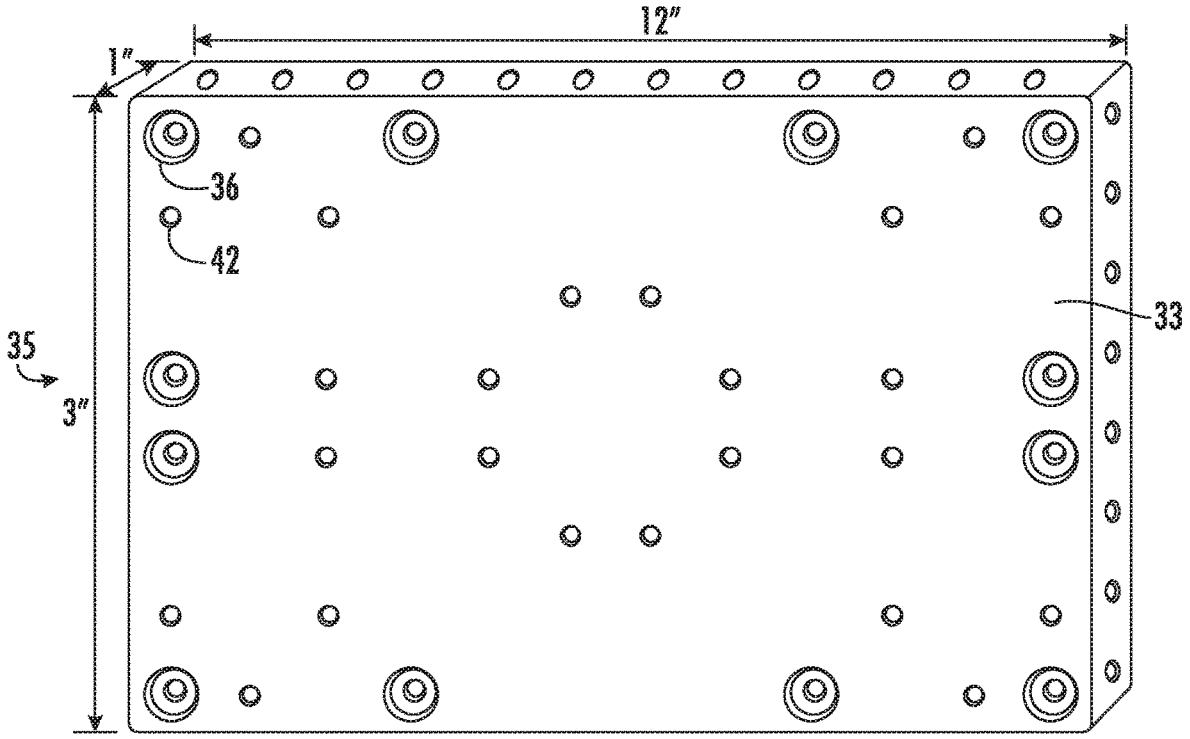
FIG. 2A is a front perspective view of a substantially rectangular-shaped block according to an exemplary embodiment of the invention.
Figure 2B:
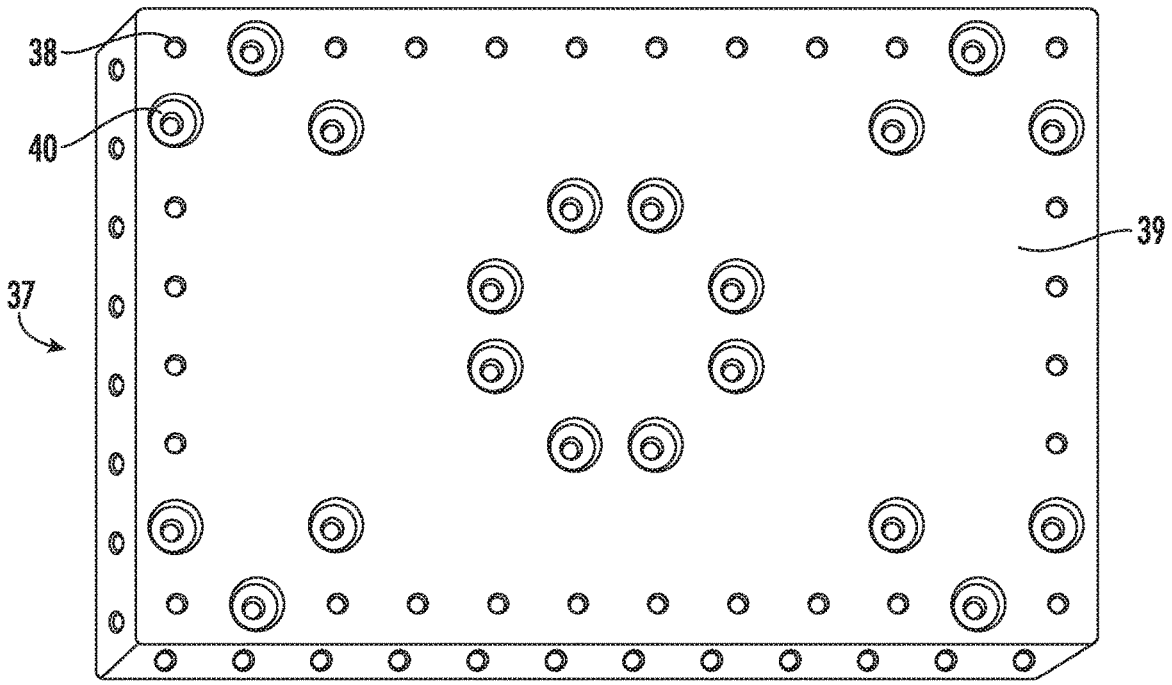
FIG. 2B is a rear perspective view of a substantially rectangular-shaped block according to an exemplary embodiment of the invention.

For example, FIG. 2A shows a front view of a rectangular-shaped block 35. Front wall 33 is shown having a plurality of screw holes. FIG. 2B shows a rear view rectangular-shaped block 37. Rear wall 39 is shown having a plurality of screw holes. Blocks 35 and 37 are configured to be complementary with each other and with other blocks of the invention. As shown, whereas recessed hole 36 on the front of block 35 terminates in non-recessed hole 38 on the rear wall of block 35, recessed holes 40 on the rear wall terminate in non-recessed holes 42. As such, when block 35 is placed atop block 37 a screw may be inserted into recessed hole 36 in order to insert into non-recessed hole 38 on block 37. Similarly, when block 37 is placed atop block 35, screws may be inserted through recessed holes 40 to engage non-recessed holes 42 on block 35.

Screws provided for connecting respective blocks to each other may be provided in any of various lengths for connecting correspondingly different sized blocks. For example, FIG. 3A-3F shows perspective side views and side views of different screws that may be used to connect blocks in embodiments of the invention. For example, in embodiments of the invention screws configured like conventional screws having a screw head, a threaded shank and a non-threaded tip (e.g. screw 48 as shown in FIG. 3B).

In embodiments of the invention, however, screws that are configured to connect blocks of the invention are configured to receive a screw emanating from a neighboring block. That is, in embodiments of the invention, respective screws are configured to insert into a first block and extend therefrom to insert into a second block. However, in addition, the screw also is configured to receive the terminal end of another screw that emanates from a third block.

Figure 3A:
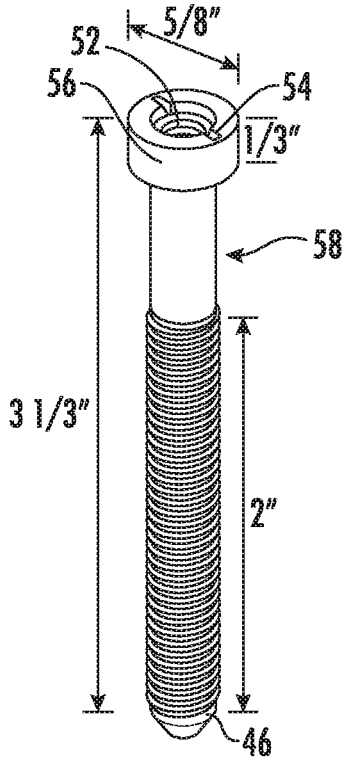
FIG. 3A is a side perspective view of a screw adapted to receive a second screw according to an exemplary embodiment of the invention.
Figure 3B:
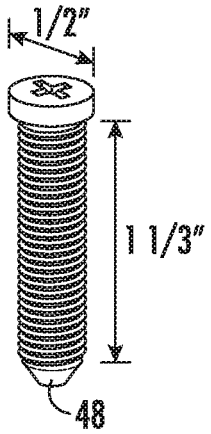
FIG. 3B is a side perspective view of a screw according to an exemplary embodiment of the invention.

For example, as best shown in the side perspective view of screw 46 in FIG. 3A, the upper aspect of screw is configured with an enlarged screw head 56. Screw head 56 is a substantially collar shaped segment that extends laterally beyond the lower shank 58 of screw 46. As will be understood, screw head 56 is substantially sized and shaped to insert into any of the recessed areas (e.g. 24) of blocks of the invention. In embodiments of the invention, a threaded channel 52 extends into screw head 56. Threads of threaded channel 52 cooperate with threads on the terminal end of a cooperating screw and threaded channel 52 is sized and shaped to receive such terminal end of a cooperating screw.

Still referring to FIG. 3A, an exemplary threaded channel 52 that is sized and shaped to receive a terminal end of a cooperating screw is shown extending into screw head 56. As such, when a first screw 46 is inserted into a first block, a terminal end of a second screw emanating from a second block may insert into the threaded channel 52 of first screw 46 in order to attached the second block to the first block.

As shown, screw 46 also is provided with a slot 54 for receiving a screw driver head.

In embodiments of the invention, thicknesses of blocks and lengths of screws are calibrated such that a screw inserts into a block, traverse the thickness of the block (i.e. width, length or height), and extends from the block a distance that is substantially equal to the length of threaded channel 52. In this regard, a terminal end of a screw from a first block may insert into the threaded channel 52 previously inserted into a second block in order to connect the first block to the second block.

It will be understood that terminal end that extends out of the block may be used to, alternatively, insert into a non-recessed hole or into a threaded channel 52 of a screw seated in a recessed hole.

Figure 3C:
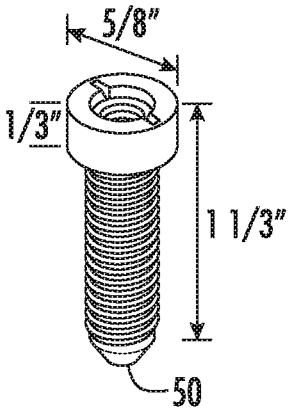
FIG. 3C is a side perspective view of a screw adapted to receive a second screw according to an exemplary embodiment of the invention.
Figure 3D:
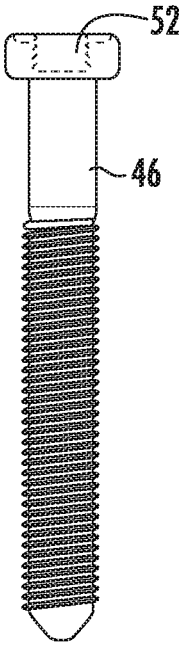
FIG. 3D is a side view of the screw shown in FIG. 3A.
Figure 3E:
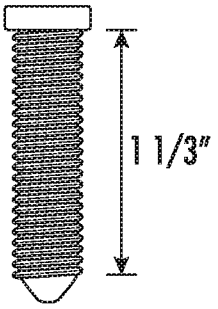
FIG. 3E is a side view of the screw shown in FIG. 3B.
Figure 3F:
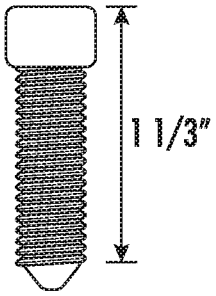
FIG. 3F a side view of the screw shown in FIG. 3C.
Figure 4A:
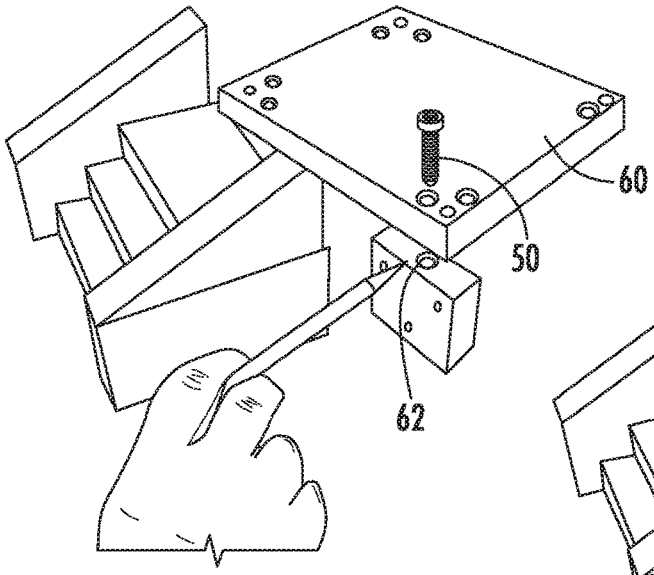
FIG. 4A shows a user aligning a lower block to support a platform according to an embodiment of the invention.
Figure 4B:
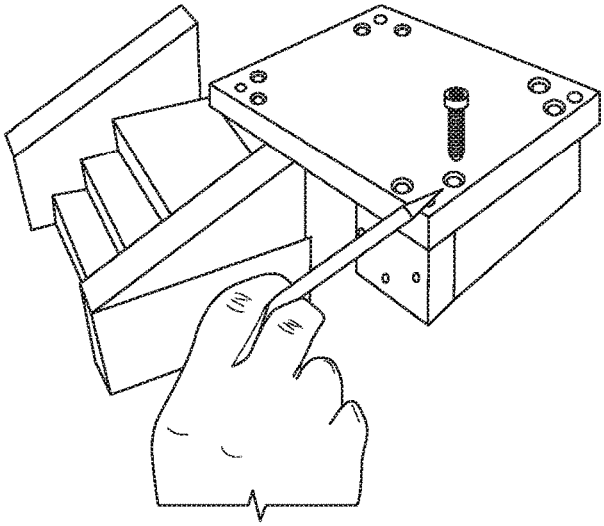
FIG. 4B show a user aligning a second lower block to support a platform according to an embodiment of the invention.
Figure 4C:
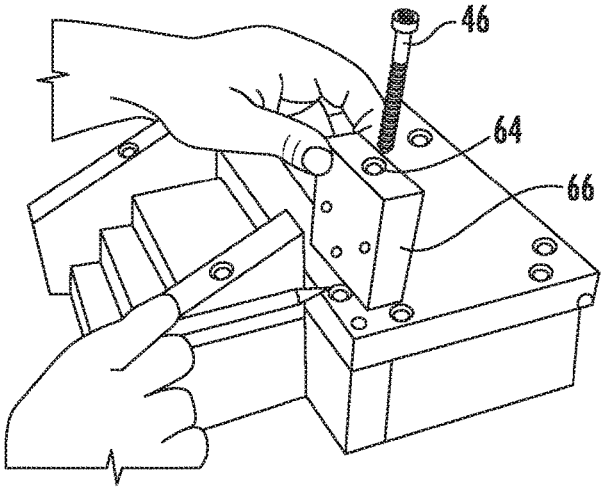
FIG. 4C shows a user aligning an upper block to attach to an upper side of a platform.
Figure 4D:
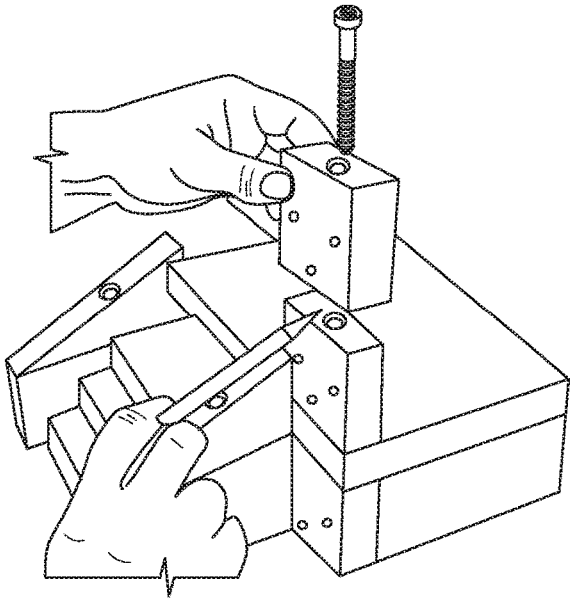
FIG. 4D shows a user aligning a second upper block to attach to an upper side of a platform.
Figure 4E:
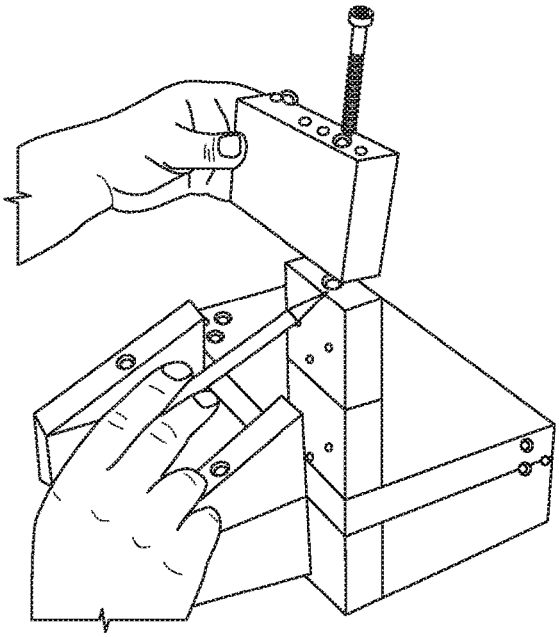
FIG. 4E shows a user aligning a third upper block to attach to an upper side of a platform.
Figure 4F:
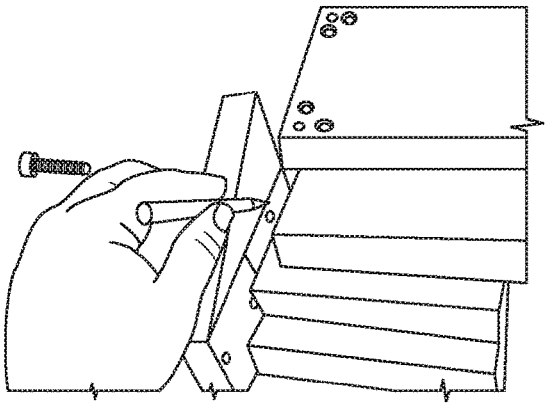
FIG. 4F show a user aligning a side block to form a staircase according to an exemplary embodiment of the invention.
Figure 4G:
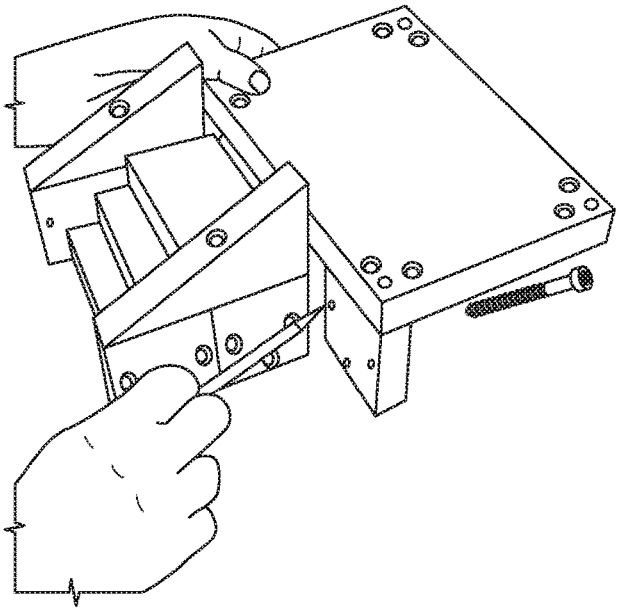
FIG. 4G shows a user aligning a staircase to attach to a platform according to an exemplary embodiment of the invention.
Figure 4H:
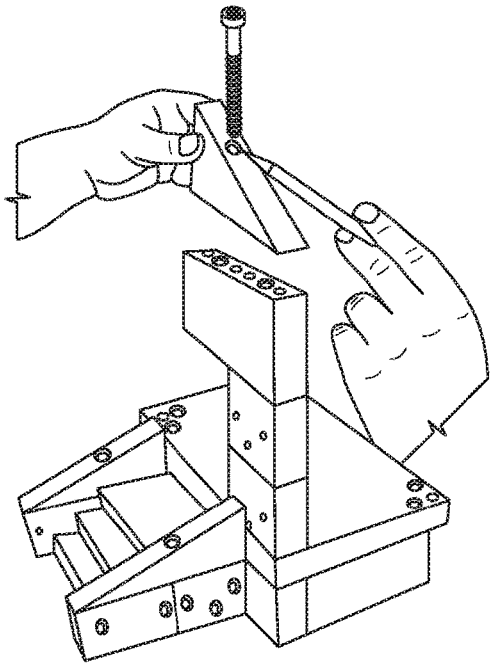
FIG. 4H shows a user aligning a triangular block to attach to an upper side of a platform according to an exemplary embodiment of the invention.
Figure 5A:
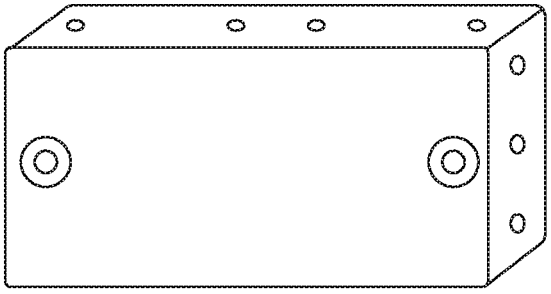
FIG. 5A is a side perspective view of a block according to embodiment of the invention.
Figure 5B:
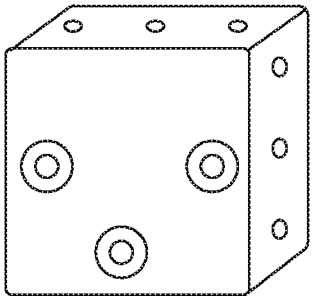
FIG. 5B is a side perspective view of a block according to embodiment of the invention.
Figure 5C:
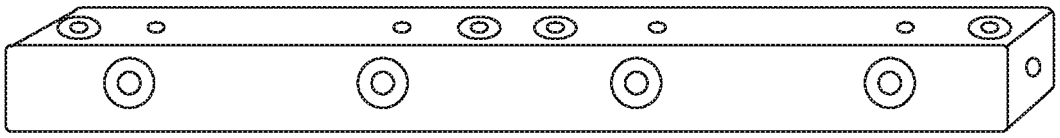
FIG. 5C is a side perspective view of a block according to embodiment of the invention.
Figure 5D:
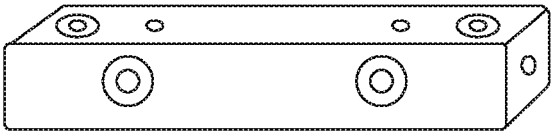
FIG. 5D is a side perspective view of a block according to embodiment of the invention.
Figure 5E:
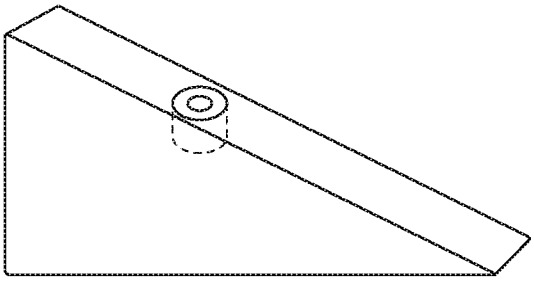
FIG. 5E is a side perspective view of a block according to embodiment of the invention.

FIG. 4A shows a user aligning blocks to install legs to support a platform. Screw 50 (as best shown in FIG. 3C) is inserted into a recessed hole in platform block 60 and which terminal end of screw 50 inserts into hole 62 of the lower block. In FIG. 4C, screw 46 is inserted through screw hole 64 of block 66. Screw 46 traverses block 66 and the terminal end of screw 46 inserts into a threaded channel disposed in the screw head of screw 50.

It will be understood by those of ordinary skill that blocks may be formed out of any of various suitable materials such as plastic, wood or the like. In addition, blocks may be formed in any of various sizes and shapes suitable for constructing toy structures.

For example, FIGS. 5A-5E show blocks of various sizes, shapes and configurations, all of which are connectable using screws as set forth herein. It should be understood that any measurements/dimensions provided in the drawings are exemplary only.

Figure 6:
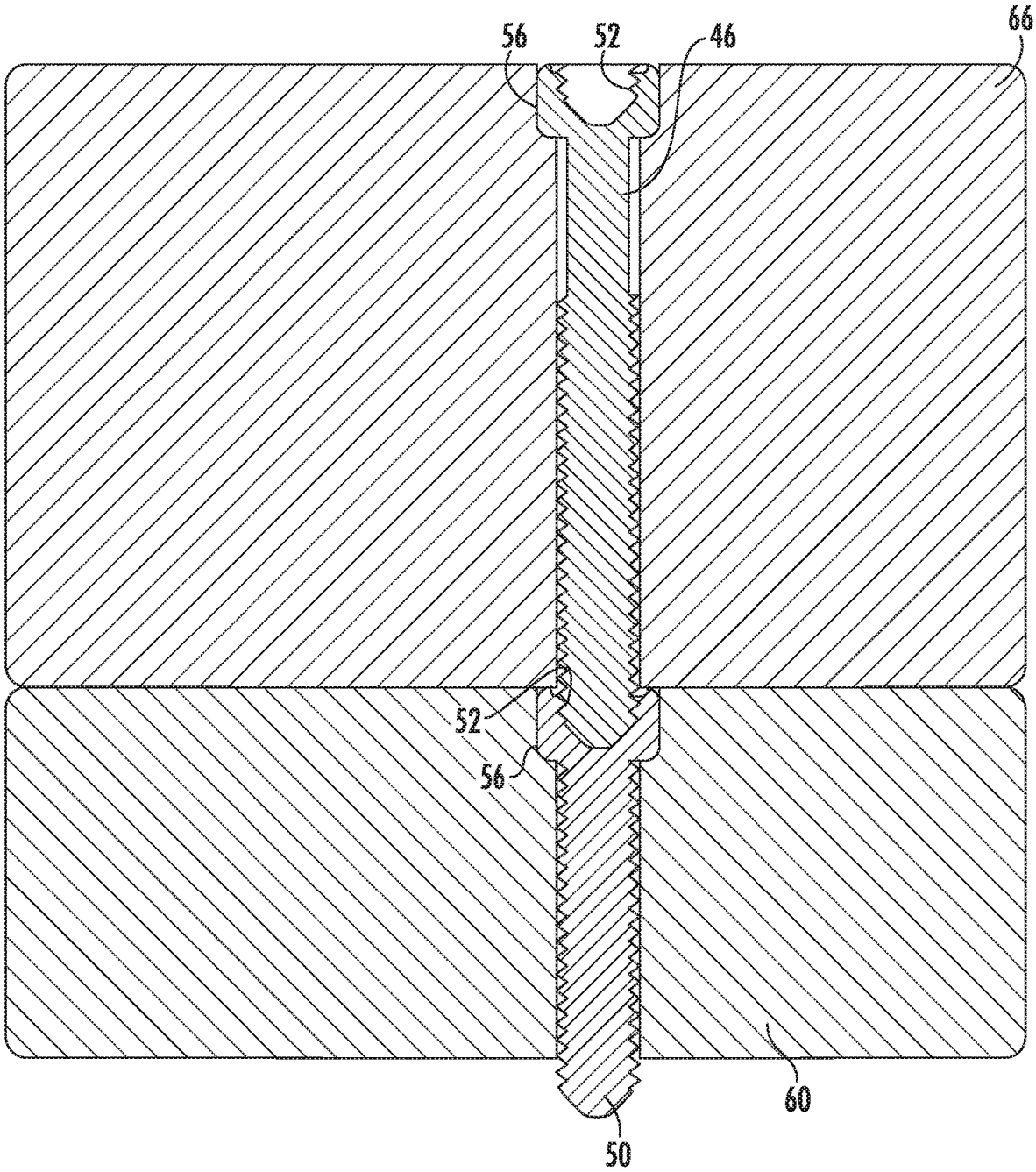
FIG. 6 shows a cross-sectional view through a first block connected to a second block by way of a first screw that inserts into an upper channel of a second screw according to an exemplary embodiment of the invention.

FIG. 6 shows a cross-sectional view through two blocks that are connected by a screw emanating from a second block and inserting into a threaded channel in a screw previously seated in a first block.

That is as shown, screw 50 is through block 60 and terminates in a lower block (not shown). A second block 66 is applied atop lower block and screw 46 is inserted through a screw hole in block 66 such that terminal end of screw 46 inserts into threaded channel 52 of in screw head 56 of screw 50. In embodiments of the invention, screw 46 is calibrated to have a sufficient length to traverse through block 66 whereby its terminal end extends and projects out of block 66 a sufficient distance to fully insert into channel 52 of screw 50. Preferably, the terminal screw segment that projects out of block 66 is sized and shaped to be received in channel 52. Thus, screw 50 functions to attach block 60 to a lower block (not shown), and also to receive a screw from an upper block 66.

It should be understood that the preferred embodiment was described to provide the best illustration of the principles of the invention and its practical application to thereby enable one of ordinary skill in the art to utilize the invention in embodiments and with various modifications as are suited to the particular use contemplated.

What is claimed is:

1. A building block set, comprising:

a first block having a top wall, a bottom wall, sidewalls, the top wall having a plurality of screw holes whereby at least one of the plurality of screw holes of the first block comprises a first recessed area in the top wall of the first block;

a second block having a top wall, a bottom wall, sidewalls, the top wall having a plurality of screw holes whereby at least one of the plurality of screw holes of the second block comprises a second recessed area in the top wall of the second block;

a first screw having a screw head configured to be seated in the first recessed area or the second recessed area, a shank segment and a terminal end;

a second screw having a screw head configured to be seated in the first recessed area or second recessed area, a shank segment and a terminal end, the screw head of the second screw further comprising a threaded channel that is configured to receive the terminal end of the first screw;

whereby the first screw is configured to be inserted through the top wall of the first block and extend past the bottom wall of the first block and threadedly engage the threaded channel of the second screw being seated in a second recessed area in the top wall of the second block.

2. The building block set of claim 1, whereby at least one of the plurality of screw holes of the first block comprises a channel extending from the recessed area.

3. The building block set of claim 1, whereby the second screw further comprise a slot being contiguous with the threaded channel, the slot configured to receive the head of a screwdriver within the slot.

4. The building block set of claim 1, whereby the first screw is of sufficient length to traverse a thickness of the first block and extend from the first block when the screw head is seated within the first recessed area, such that the screw segment that extends from the first block is sized and shaped to be received in the threaded channel of the second screw when the second screw is seated in the second recessed area.

* * * * *